US009987848B2

(12) United States Patent
Hirosawa et al.

(10) Patent No.: US 9,987,848 B2
(45) Date of Patent: Jun. 5, 2018

(54) INK JET RECORDING APPARATUS AND CLEANING METHOD THEREOF

(71) Applicant: CANON KABUSHIKI KAISHA, Tokyo (JP)

(72) Inventors: Susumu Hirosawa, Tokyo (JP); Minoru Teshigawara, Saitama (JP); Atsushi Sakamoto, Yokohama (JP); Yoshiaki Murayama, Tokyo (JP); Takatoshi Nakano, Yokohama (JP); Takahide Takeishi, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/626,569

(22) Filed: Jun. 19, 2017

(65) Prior Publication Data

US 2018/0001644 A1 Jan. 4, 2018

(30) Foreign Application Priority Data

Jun. 29, 2016 (JP) ..... 2016-129400

(51) Int. Cl.
*B41J 2/165* (2006.01)

(52) U.S. Cl.
CPC ..... *B41J 2/16517* (2013.01); *B41J 2/16585* (2013.01); *B41J 2/16588* (2013.01); *B41J 2002/1657* (2013.01); *B41J 2002/16573* (2013.01); *B41J 2002/16591* (2013.01)

(58) Field of Classification Search
CPC ..... B41J 2002/1657; B41J 2002/16573; B41J 2/16517; B41J 2/16585; B41J 2/16588; B41J 2002/16591
See application file for complete search history.

(56) References Cited

U.S. PATENT DOCUMENTS

| | | | | |
|---|---|---|---|---|
| 9,573,374 | B2 * | 2/2017 | Wakabayashi | B41J 2/16517 |
| 2014/0035989 | A1 * | 2/2014 | Ohhashi | B41J 13/0009 347/16 |
| 2015/0298475 | A1 * | 10/2015 | Kuypers | B41J 2/16535 347/19 |

FOREIGN PATENT DOCUMENTS

JP 2011-104864 A 6/2011

* cited by examiner

*Primary Examiner* — Henok Legesse
(74) *Attorney, Agent, or Firm* — Canon U.S.A., Inc. IP Division

(57) ABSTRACT

An ink jet recording apparatus includes a recording head having a nozzle arrangement region in which a plurality of nozzles for discharging ink is arranged, and a cleaning unit configured to perform cleaning operation on the recording head. A control unit is configured to control the cleaning unit and a change operation for changing relative position relation between a region where the record medium passes and the nozzle arrangement region. The control unit acquires end passage positions in a first recording operation before the change operation is performed, and a passage region in a second recording operation after the change operation is performed. The control unit performs control for executing the cleaning operation in a case where the end passage position is included in the passage region.

11 Claims, 14 Drawing Sheets

FIG.14A

| CONVEYANCE SPEED | FACTOR |
|---|---|
| 1.0 inch/sec | 0.6 |
| 1.5 inch/sec | 0.7 |
| 2.0 inch/sec | 0.8 |
| 2.5 inch/sec | 0.9 |
| 3.0 inch/sec | 1 |
| 3.5 inch/sec | 1.1 |
| 4.0 inch/sec | 1.2 |
| 4.5 inch/sec | 1.3 |
| 5.0 inch/sec | 1.4 |

FIG.14B

| TYPE OF RECORD MEDIUM | FACTOR |
|---|---|
| a | 1 |
| b | 1.2 |
| c | 1.4 |
| d | 1.6 |
| e | 1.8 |
| f | 0.2 |
| g | 0.4 |
| h | 0.6 |
| i | 0.8 |

INK JET RECORDING APPARATUS AND CLEANING METHOD THEREOF

BACKGROUND OF THE INVENTION

Field of the Invention

The present invention relates to an ink jet recording apparatus for recording an image by ejecting ink from a recording head and a cleaning method thereof.

Description of the Related Art

An ink jet recording apparatus discussed in Japanese Patent Application Laid-Open No. 2011-104864 cleans a line-type recording head using a cleaning mechanism having a suction unit. The line-type recording head has a plurality of nozzle chips arranged in a sheet conveyance direction. The cleaning mechanism can remove ink and dust adhering to a nozzle face of the recording head, by reciprocally moving in a direction intersecting the sheet conveyance direction. This can reduce ejection failures attributable to clogging of the nozzles of the recording head.

The ink jet recording apparatus discussed in Japanese Patent Application Laid-Open No. 2011-104864 performs a cleaning operation on all nozzles of a recording head, every time when a change operation in which an area where a record medium passes is changed is performed. The throughput of recording is therefore sometimes decreased.

SUMMARY OF THE INVENTION

Embodiments of the present invention are directed to an ink jet recording apparatus that performs a cleaning operation at an appropriate timing, on a nozzle of a recording head opposite a position where an end of the record medium passes.

According to embodiments of the present invention, an ink jet recording apparatus includes a conveyance unit configured to convey a record medium in a first direction, a recording head having a nozzle arrangement region in which a plurality of nozzles for discharging ink is arranged in a second direction intersecting the first direction, the recording head being configured to perform a recording operation for recording on the record medium, a cleaning unit configured to perform a cleaning operation on the recording head, and a control unit configured to control the cleaning operation performed by the cleaning unit. A change operation changes relative position relation between a region where the record medium passes and the nozzle arrangement region. The control unit acquires end passage positions and a passage region, the end passage positions being positions in the nozzle arrangement region facing to positions where two side edges of the record medium in the second direction pass in a first recording operation before the change operation is performed, and the passage region being a region in the nozzle arrangement region facing to a region where the record medium passes in a second recording operation after the change operation is performed. The control unit performs control for executing the cleaning operation in a case where the end passage position is included in the passage region, and control for not executing the cleaning operation in a case where the end passage position is not included in the passage region.

Further features of the present invention will become apparent from the following description of exemplary embodiments with reference to the attached drawings.

BRIEF DESCRIPTION OF THE DRAWINGS

FIGS. 14A and 14B are diagrams each illustrating a table of factor for multiplying a conveyance amount according to a third exemplary embodiment.

DESCRIPTION OF THE EMBODIMENTS

An ink jet recording apparatus according to exemplary embodiments of the invention will be described. Components described in the exemplary embodiments are not intended to limit the scope of the invention. In the present specification, liquids including a recording liquid, a fixing process liquid, and a resist are collectively referred to as "ink". Further, in the present specification, "recording" includes not only recording for a flat object, but also recording for a three-dimensional object. In the present specification, an ejection opening or a liquid path connecting thereto, and an element for producing energy to be used for ink ejection are collectively referred to as "nozzle". In the present specification, record media to which liquids are ejected are collectively referred to as "sheet". Examples of the record media include sheets of paper, clothes, plastic films, metal plates, glasses, ceramics, wood materials, and leathers. The examples further include roll-type continuous sheets and cut sheets. In addition, in the present specification, "end" includes not only an end itself of a record medium, but also a part near the end.

Figure 1:
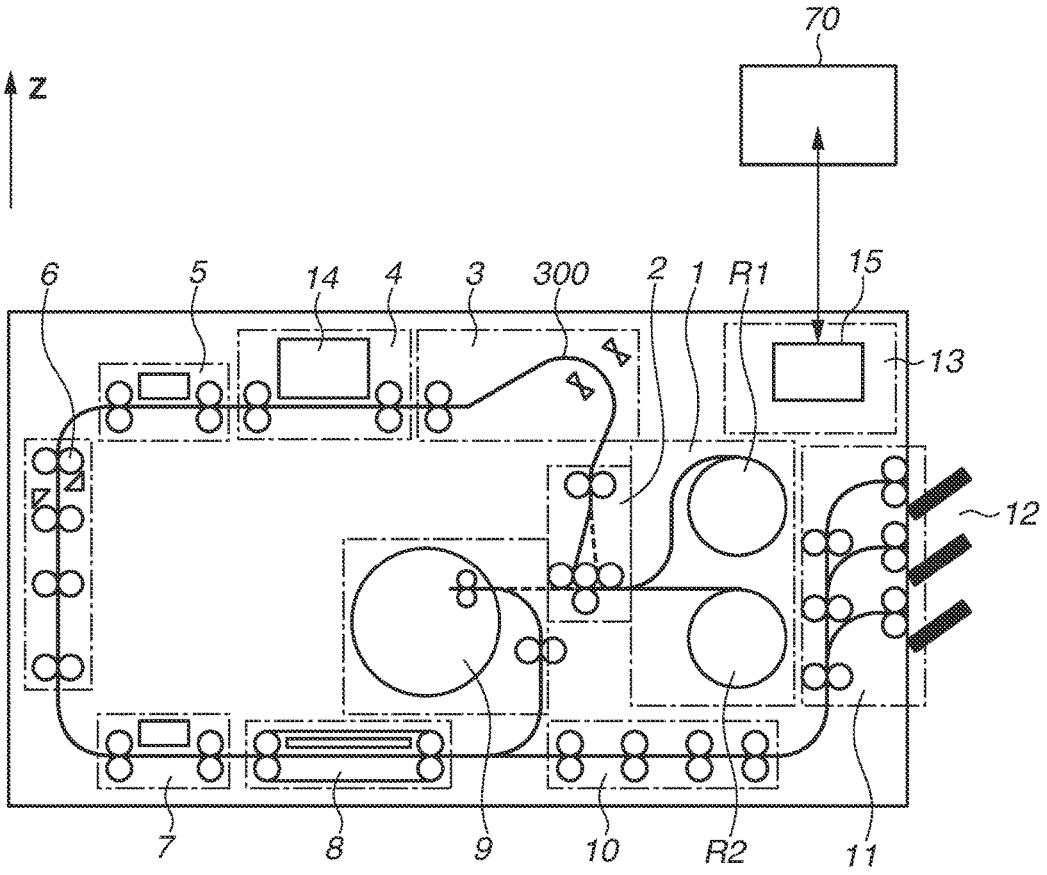
FIG. 1 is a cross-sectional schematic view of an inner structure of a recording apparatus according to a first exemplary embodiment.

FIG. 1 is a cross-sectional schematic view of an inner structure of an ink jet recording apparatus (hereinafter may be simply referred to as "recording apparatus") 100 according to an exemplary embodiment. The recording apparatus 100 includes a feeding unit 1, a curl correction unit 2, a skew correction unit 3, a recording unit 4, an inspection unit 5, a cutter unit 6, an information recording unit 7, a drying unit 8, a sheet winding unit 9, a discharge conveyance unit 10, a sorter unit 11, a discharge tray 12, and a control unit 13. A sheet (a record medium) 300 is conveyed by a conveyance unit including roller pairs and belts, along a conveyance route indicated with a solid line in FIG. 1, and processing is performed in each of the units.

The feeding unit 1 contains and feeds the sheet 300 wound in a roll. The feeding unit 1 can contain two rolls R1 and R2, and supplies the sheet 300 by feeding the sheet 300 from either the roll R1 or the roll R2. The number of rolls that can be contained is not limited to two, and may be one, or three or more. The curl correction unit 2 reduces a curl (a warp) of the sheet 300 supplied from the feeding unit 1. The curl correction unit 2 corrects a curl by drawing a sheet so as to give the sheet a warp in the opposite direction of the curl, using two pinch rollers for one driving roller, to reduce the curl. The skew correction unit 3 corrects a skew of the sheet 300 (an inclination of the sheet 300 with respect to a sheet conveyance direction) after the sheet 300 passes through the curl correction unit 2. The skew correction unit 3 corrects the skew of the sheet 300 by pressing one end of the sheet 300 to a guide member. The one end is a reference in a width direction.

The recording unit 4 includes a recording head 14. The recording unit 4 performs a recording operation for recording an image on the sheet 300 being conveyed, using the recording head 14. The recording unit 4 further includes a plurality of conveyance rollers for conveying the sheet 300. The recording head 14 is a line-type recording head. The recording head 14 has nozzle arrays 221 (see FIG. 5B) of an ink jet system. The nozzle arrays 221 are provided in a range corresponding to the maximum width of the sheet 300 assumed to be used. Adoptable examples of the ink jet system include a system using a heating element, a system using a piezo element, a system using an electrostatic element, and a system using a microelectromechanical (MEMS) element. The ink of each color is supplied to the recording head 14 via an ink tube from an ink tank.

The inspection unit 5 optically reads an inspection pattern and an image recorded on the sheet 300 in the recording unit 4 to inspect, for example, a nozzle state of the recording head 14, a sheet conveyance state, and an image position. The cutter unit 6 includes a mechanical cutter for cutting the sheet 300 at a predetermined position, after the recording is performed on the sheet 300. The cutter unit 6 further includes a plurality of conveyance rollers for sending out the sheet 300 to the next process. The information recording unit 7 records recording information including a serial number and a date on the back surface of the cut sheet 300. The drying unit 8 dries the ink applied on the sheet 300 in a short time by heating the sheet 300, after the recording is performed on the sheet 300 in the recording unit 4. The drying unit 8 includes conveyance belts and conveyance rollers for sending out the sheet 300 to the next process.

The sheet winding unit 9 temporarily winds the sheet 300 for which front surface recording is completed in double-sided recording. The sheet winding unit 9 includes a winding drum that winds the sheet 300 by rotating. The winding drum temporarily winds the sheet 300 for which the front surface recording is completed but is not yet cut for each image. Upon completing the winding, the winding drum rotates in the opposite direction to supply the wound sheet 300 to the curl correction unit 2 so that the sheet 300 is sent to the recording unit 4. The sheet 300 is turned upside down by such reverse rotation of the winding drum. The recording unit 4 can therefore perform recording on the back surface of the sheet 300. A specific operation of the double-sided recording will be described below.

The discharge conveyance unit 10 conveys the sheet 300 cut in the cutter unit 6 and then dried in the drying unit 8, to the sorter unit 11. The sorter unit 11 discharges the sheet 300 after the recording, by distributing pieces of the sheet 300 to the discharge tray 12 different for each group, as necessary. The control unit 13 controls each of the units of the entire recording apparatus 100. The control unit 13 has a central processing unit (CPU), a memory, a controller 15 with various input/output (I/O) interfaces, and a power supply. The operation of the recording apparatus 100 is controlled based on commands from the controller 15, or commands from an external apparatus 70, such as a host computer, connected to the controller 15 via an I/O interface.

Figure 2A:
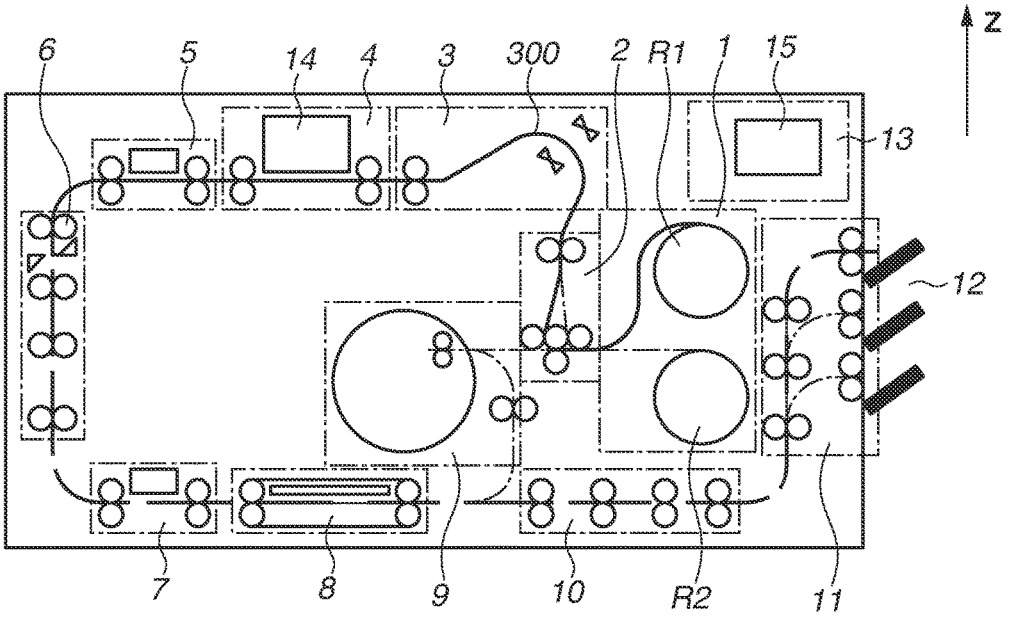
FIGS. 2A and 2B are diagrams each illustrating movements of a sheet and each unit in single-sided recording according to the first exemplary embodiment.

Next, movements of the sheet 300 and each of the units in the recording operation will be described with reference to FIGS. 2A and 2B. FIG. 2A is a diagram illustrating an operation in single-sided recording. A bold line indicates a conveyance route from recording on the sheet 300 supplied from the feeding unit 1 to discharge of the sheet 300 to the discharge tray 12. The sheet 300 supplied from the feeding unit 1 is processed in the curl correction unit 2 and then in the skew correction unit 3. The recording unit 4 then performs the recording operation for the front surface of the sheet 300. The sheet 300 after the recording is inspected by the inspection unit 5 and then cut in the cutter unit 6 for each image. After cutting of the sheet 300, the information recording unit 7 records the recording information on the back surface of each piece of the sheet 300, as necessary. The pieces of the sheet 300 are then conveyed one by one to the drying unit 8 and dried therein. The pieces of the sheet 300 are then sequentially discharged to the discharge tray 12 of the sorter unit 11 via the discharge conveyance unit 10 and stacked on the discharge tray 12.

Figure 2B:
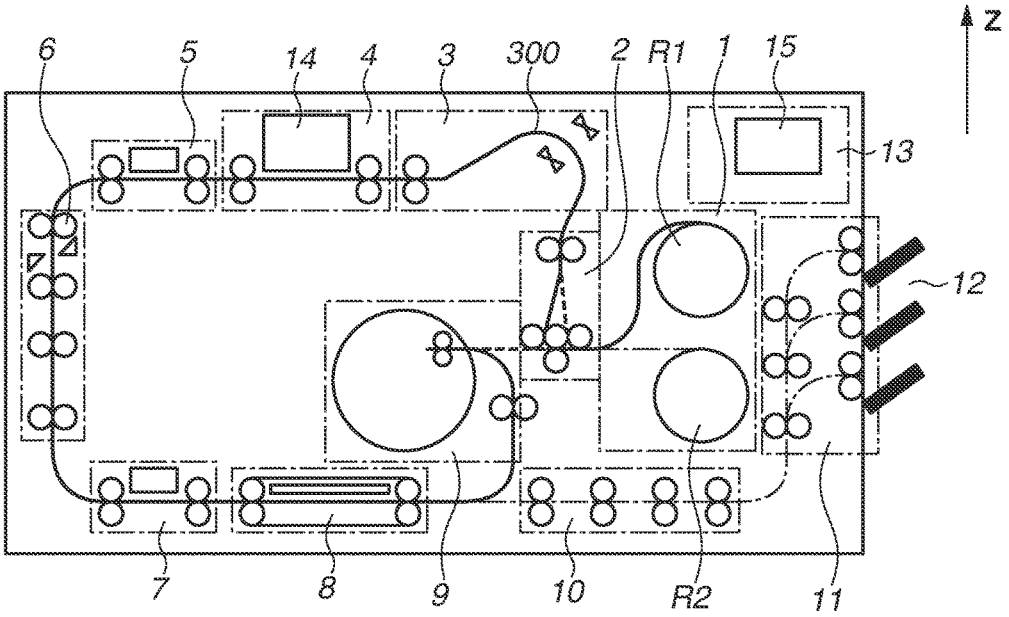

FIG. 2B is a diagram illustrating an operation in the double-sided recording. In the double-sided recording, a back surface recording sequence operation is executed subsequent to a front surface recording sequence operation. First, in the front surface recording sequence, each of the units including the feeding unit 1 to the inspection unit 5 performs an operation similar to that in the single-sided recording described above. Next, the sheet 300 in a continuous sheet state is conveyed to the drying unit 8, without being cut for each image in the cutter unit 6. The drying unit 8 then dries the ink on the front surface of the sheet 300. After that, the sheet 300 is guided to a path extending in an upward direction (a Z direction) toward the sheet winding unit 9, but is not conveyed to a path extending in a rightward direction toward the discharge conveyance unit 10, as illustrated in FIG. 2B. The guided sheet 300 is then wound by the winding drum of the sheet winding unit 9 rotating in a forward direction (a counterclockwise direction in FIG. 2B). When all the planned recording on the front surface is completed in the recording unit 4, the cutter unit 6 cuts only the tail end of a recording area of the sheet 300 in a continuous sheet state. The sheet 300 of a portion on a side downstream from the cut position (the side on which the recording is performed) in the sheet conveyance direction is wound by the sheet winding unit 9 up to the tail end (the cut position) after going through the drying unit 8. On the other hand, the sheet 300 in a continuous sheet state on a side upstream from the cut position in the sheet conveyance direction is rewound by the feeding unit 1 so that the leading end (the cut position) leaves the curl correction unit 2.

After the above-described front surface recording sequence operation, the operation switches to the back surface recording sequence operation. The winding drum of the sheet winding unit 9 rotates in the direction (a clockwise direction in FIG. 2B) opposite to the direction in the winding. The end of the sheet 300 wound by the sheet winding unit 9 is sent into the curl correction unit 2 (the tail end of the sheet in the winding becomes the leading end of the sheet in sending out). The curl correction unit 2 corrects a curl again. Subsequently, after the sheet 300 goes through the skew correction unit 3, the recording unit 4 performs recording on the back surface of the sheet 300. The inspection unit 5 inspects the sheet 300 after the recording, and then the cutter unit 6 cuts the sheet 300 for each image. Since the recording is performed on both surfaces of each piece of the sheet 300 resulting from the cutting, the information recording unit 7 performs no recording. Afterward, the pieces of the sheet 300 are conveyed to the drying unit 8 one by one, and then sequentially discharged to the discharge tray 12 of the sorter unit 11, via the discharge conveyance unit 10.

Figure 3:
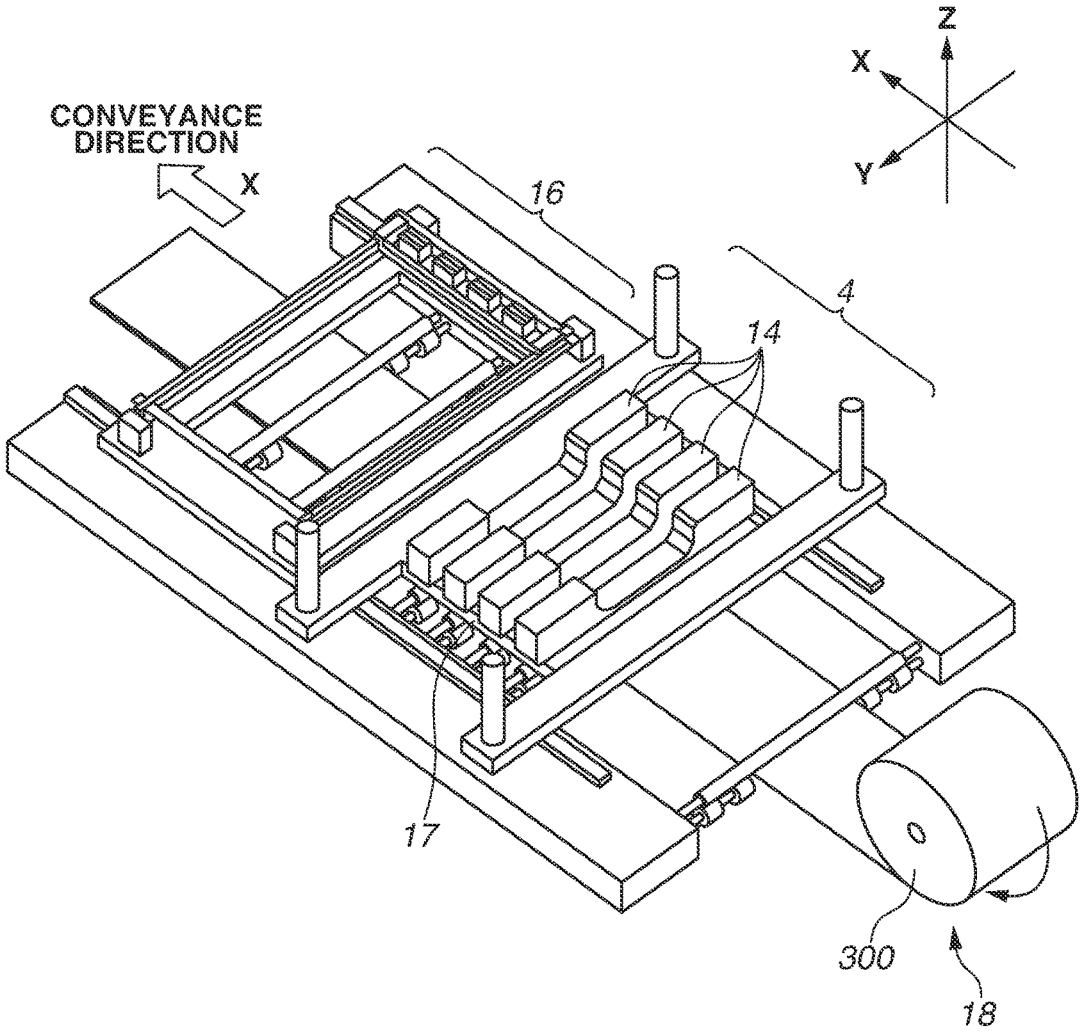
FIG. 3 is a diagram illustrating movements of a sheet and each unit in double-sided recording according to the first exemplary embodiment.

FIG. 3 is a perspective view of a configuration of a main part in which the recording unit 4 is a main unit. The recording unit 4 performs a recording operation, using the recording head 14 of the line-type, which employs the ink jet system and discharges ink over the entire width of the sheet 300 being conveyed. In the recording unit 4, a plurality of recording heads 14, each of which is the recording head 14 described above, is arranged in an X direction (a sheet conveyance direction, or a first direction). In the present exemplary embodiment, the recording unit 4 has the four recording heads 14 corresponding to four colors of cyan, magenta, yellow, and black. The number of the colors and the types of the colors of the ink are not limited to this example. The X direction in FIG. 3 will be referred to below as the sheet conveyance direction.

Further, a conveyance unit 17 and a holder 18 (the roller R1 or R2 in FIG. 1) are provided around the recording unit 4. The conveyance unit 17 conveys the sheet 300 in the sheet conveyance direction at a predetermined speed. The holder 18 is disposed upstream of the recording head 14 in the sheet conveyance direction and holds the sheet 300. Furthermore, a cleaning unit 16 is provided around the recording unit 4. The cleaning unit 16 performs a cleaning operation for removing deposits adhering to a nozzle face 200 (see FIG. 5B) of the recording head 14. In the present specification, a Y direction (a second direction) intersecting the X direction in FIG. 3 will be referred to as a nozzle arranging direction, and a Z direction in FIG. 3 will be referred to as a vertical direction.

Figure 4A:
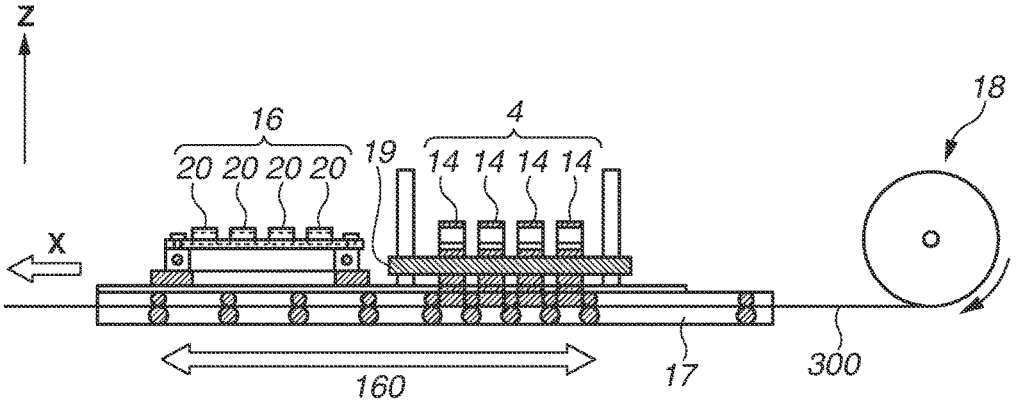
FIGS. 4A and 4B are diagrams illustrating a configuration of a main part in which a recording unit is a main unit according to the first exemplary embodiment.
Figure 4B:
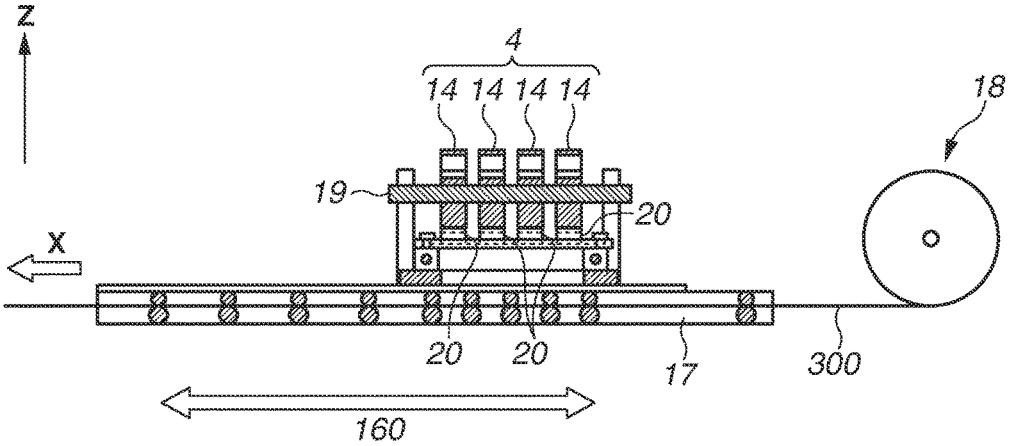

FIGS. 4A and 4B are cross-sectional diagrams of the main part in which the recording unit 4 is the main unit. FIG. 4A is a cross-sectional diagram of the main part illustrated in FIG. 3, and illustrates a state when the recording operation is performed by the recording head 14. FIG. 4B illustrates a state when the cleaning operation is performed by the cleaning unit 16. The recording heads 14 are integrally held by a head holder 19. In addition, the recording apparatus 100 has a mechanism for moving the head holder 19 in the vertical direction to change the distance between the recording head 14 and the surface of the sheet 300. The recording apparatus 100 further has a mechanism for moving the head holder 19 in the nozzle arranging direction.

The cleaning unit 16 has four cleaning mechanisms 20 corresponding to the four recording heads 14. The cleaning unit 16 is slidable in the sheet conveyance direction by a driving motor 41 (see FIGS. 6A and 6B). A range indicated with an arrow 160 illustrated in each of FIGS. 4A and 4B is a range in which the cleaning unit 16 can move. The cleaning unit 16 is located downstream of the recording unit 4 in the sheet conveyance direction during the recording operation as illustrated in FIG. 4A. Meanwhile, the cleaning unit 16 is located immediately below the recording head 14 in the vertical direction during the cleaning operation as illustrated in FIG. 4B. In this way, the cleaning unit 16 is movable between a standby position illustrated in FIG. 4A and a cleaning position illustrated in FIG. 4B.

Figure 5A:
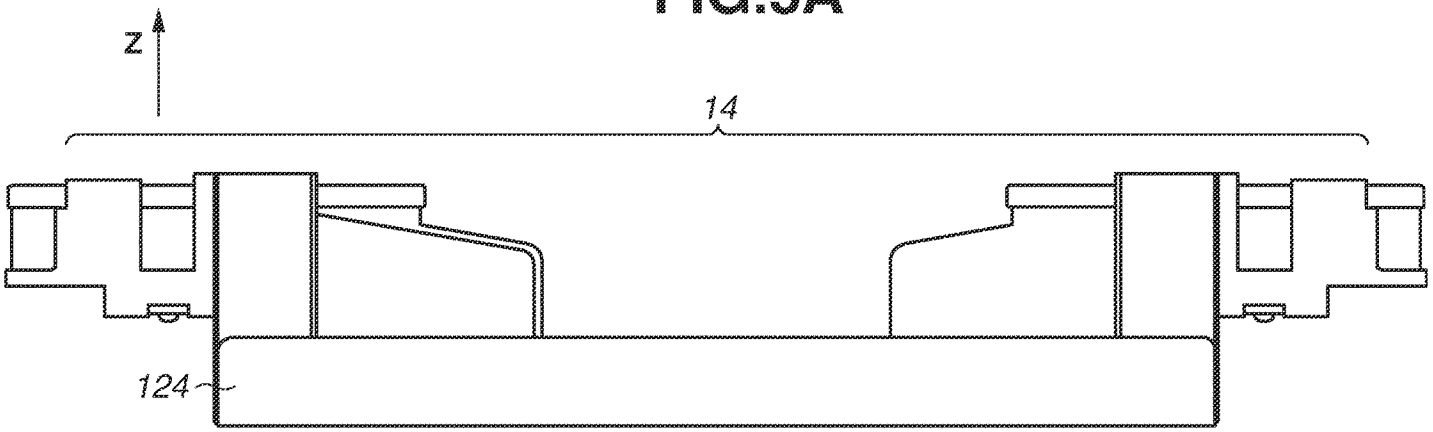
FIGS. 5A and 5B are diagrams illustrating a structure of the recording head according to the first exemplary embodiment.
Figure 5B:
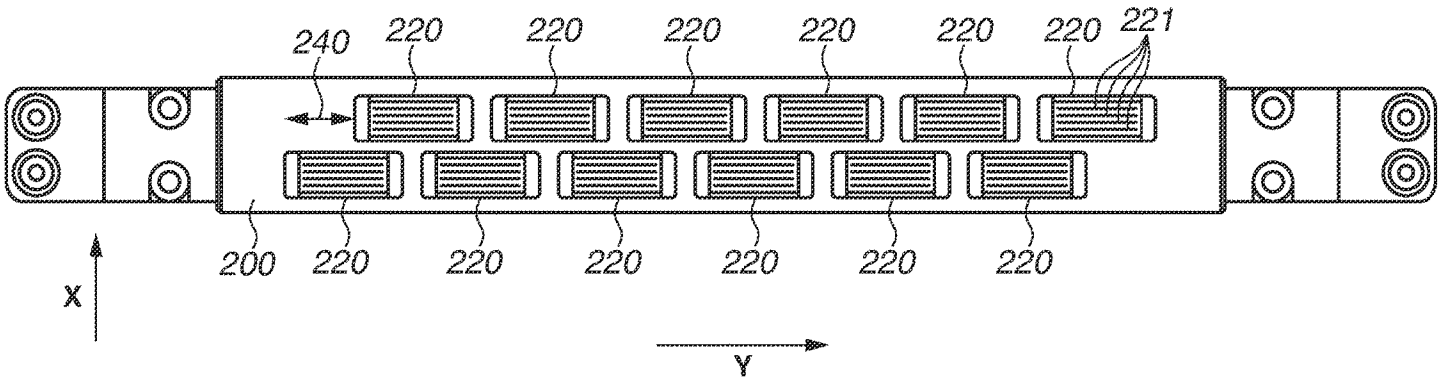

FIGS. 5A and 5B are diagrams illustrating a structure of the recording head 14. FIG. 5A is a cross-sectional diagram of the recording head 14, and FIG. 5B is a diagram when the recording head 14 is viewed from the sheet 300. The recording head 14 of the present exemplary embodiment has a plurality of (in the present exemplary embodiment, twelve) nozzle chips 220 (a nozzle arrangement region). The nozzle chips 220 are disposed on the nozzle face 200, which is opposite the sheet 300 during the recording operation, of a base substrate 124. The nozzle chips 220 are identical in terms of the size and structure, and arranged in the nozzle arranging direction. The nozzle chips 220 are arranged in two arrays extending in the sheet conveyance direction, in a staggered manner. An array on upstream side in the sheet conveyance direction is referred to as a first nozzle chip array. An array on downstream side in the sheet conveyance direction is referred to as a second nozzle chip array. Each of the nozzle chips 220 has a plurality of nozzle arrays 221, each of which is the nozzle array 221 described above. Each of the nozzle arrays 221 has a plurality of nozzles arranged in the nozzle arranging direction.

Figure 6A:
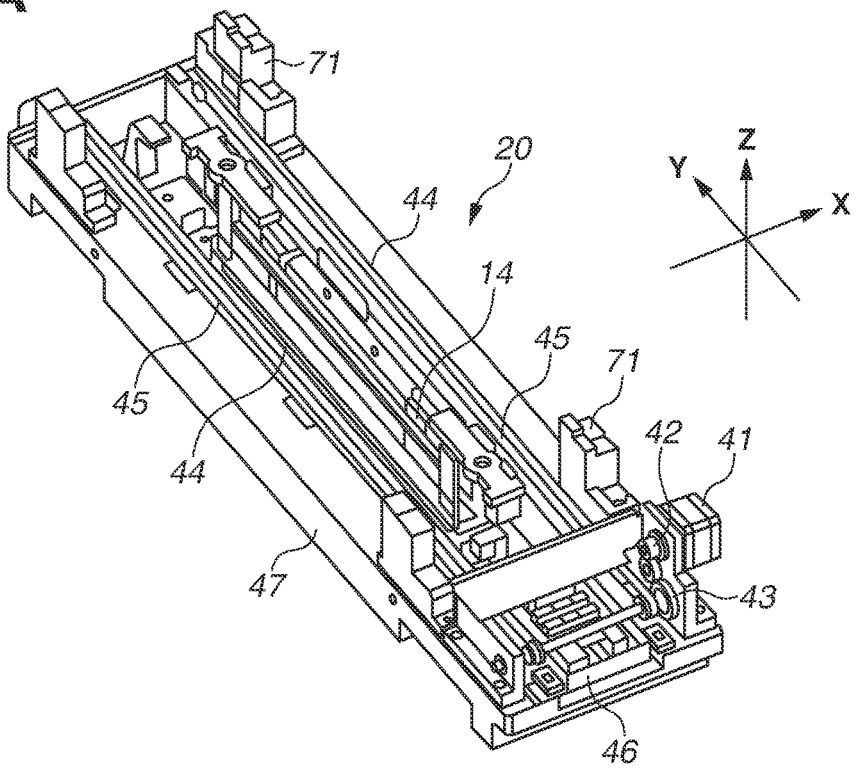
FIGS. 6A and 6B are perspective views of a detailed configuration of a cleaning mechanism according to the first exemplary embodiment.
Figure 6B:
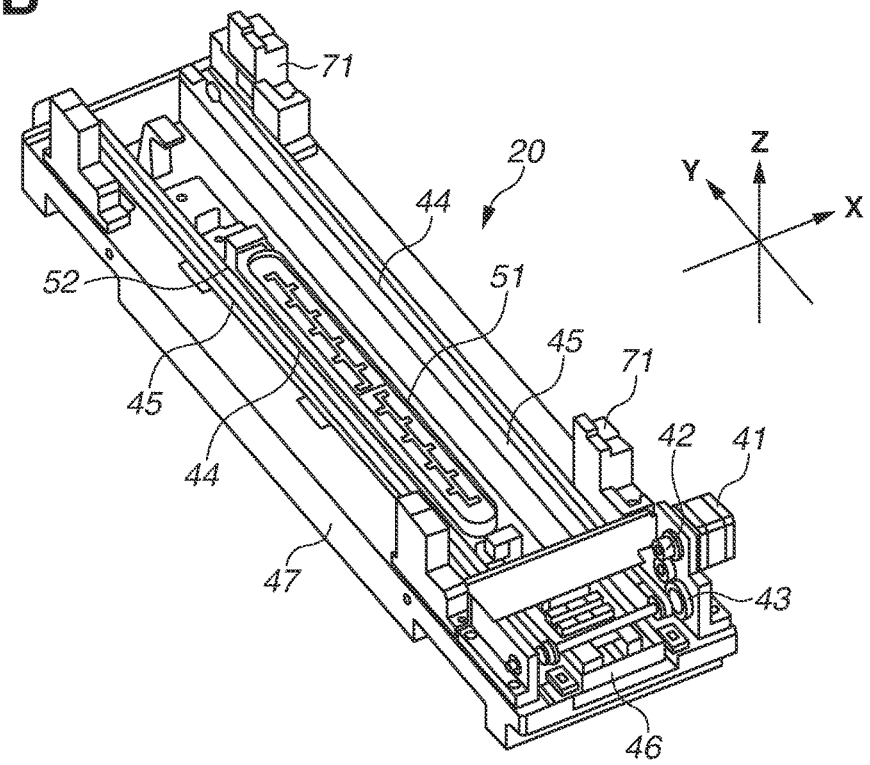

FIGS. 6A and 6B are perspective views of a detailed configuration of a cleaning mechanism 20. FIG. 6A illustrates a state that the recording head 14 is located immediately above the cleaning mechanism 20 in the vertical direction (during the cleaning operation). FIG. 6B illustrates a state that the recording head 14 is not located immediately above the cleaning mechanism 20 in the vertical direction. In other words, the cleaning unit 16 is located at the cleaning position in FIG. 6A, and the cleaning unit 16 is located at the standby position in FIG. 6B.

The cleaning unit 16 includes a cap 51 and a positioning member 71, in addition to the cleaning mechanism 20. The cleaning mechanism 20 has a wiper unit 46 for removing deposits adhering to the nozzle face 200 of the recording head 14. The cleaning mechanism 20 further has a movement mechanism for moving the wiper unit 46 in a wiping direction (the nozzle arranging direction). The cleaning mechanism 20 further has a frame 47 for integrally supporting the wiper unit 46 and the movement mechanism. The movement mechanism is driven by a driving source to move the wiper unit 46 guided and supported by two shafts 45, in the nozzle arranging direction. The driving source has the driving motor 41 and reduction gears 42 and 43. The driving source moves the wiper unit 46, by rotating a drive shaft (not illustrated) via a component, such as a belt 44. Therefore, components including the driving motor 41, the reduction gears 42 and 43, and the belt 44 correspond to the movement mechanism.

A cap holder 52 holds the cap 51 as illustrated in FIG. 6B. The cap holder 52 is biased by a spring toward the nozzle face 200 of the recording head 14 in the vertical direction. The cap holder 52 is thereby movable while resisting the elastic force of the spring. When the recording head 14 moves in the vertical direction in a state that the frame 47

(the cleaning unit 16) is at the cleaning position, the recording head 14 can move between a capping position and a separation position. The recording head 14 is covered with the cap 51, at a capping position. The recording head 14 is away from the cap 51, at a separation position. At the capping position, the nozzle face 200 of the recording head 14 is covered (capped) with the cap 51 to prevent the nozzles from drying.

The positioning member 71 of the cleaning unit 16 is a member that determines a positional relationship between the recording head 14 and the cleaning unit 16. Specifically, the positioning member 71 is configured to abut on a head positioning member (not illustrated) provided on the head holder 19, in three directions, which are the sheet conveyance direction, the nozzle arranging direction, and the vertical direction, during the cleaning operation and the capping.

Figure 7A:
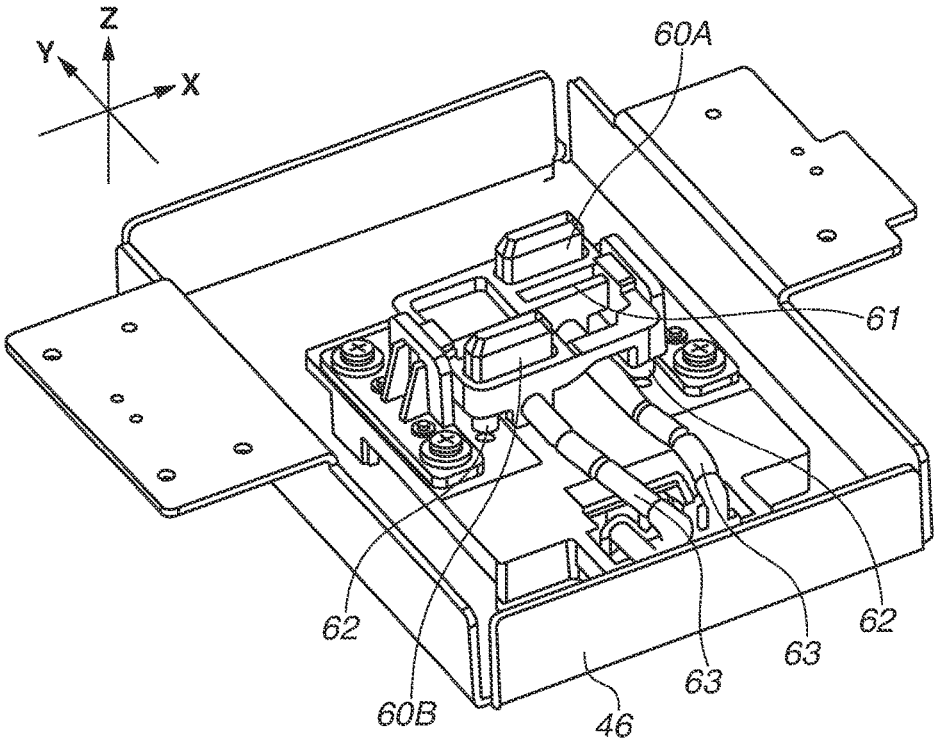
FIGS. 7A and 7B are diagrams illustrating a configuration of a wiper unit according to the first exemplary embodiment.
Figure 7B:
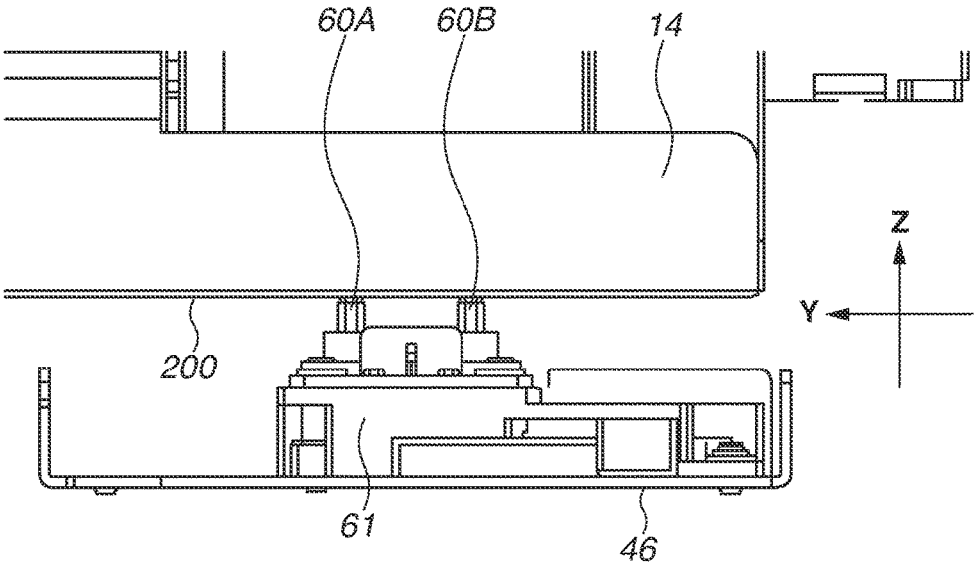

FIGS. 7A and 7B are diagrams illustrating a configuration of the wiper unit 46. FIG. 7A is a perspective view of the cleaning mechanism 20. FIG. 7B is a side view of the cleaning mechanism 20, and illustrates the operation of the cleaning mechanism 20. The wiper unit 46 of the present exemplary embodiment is a suction wiper that performs wiping while performing suction on the nozzle face 200. The wiper unit 46 has two suction ports (suction units) 60A and 60B corresponding to the first and second nozzle chip arrays. The suction ports 60A and 60B are arranged at the same interval as the interval of the first and second nozzle chip arrays, in the sheet conveyance direction. Meanwhile, in the nozzle arranging direction, the suction ports 60A and 60B are arranged by substantially the same amount as the amount of displacement (a predetermined distance) in the nozzle arranging direction between the nozzle chips 220 next to each other in the sheet conveyance direction on the nozzle face 200 illustrated in FIG. 5B. In other words, the suction ports 60A and 60B are arranged by the amount indicated with an arrow 240 illustrated in FIG. 5B, in the nozzle arranging direction. This allows wiping of the nozzle chips 220 in the first nozzle chip array and the nozzle chips 220 in the second nozzle chip array to be started almost at the same time.

A suction holder 61 holds the suction ports 60A and 60B. The suction holder 61 is biased by a spring 62 in the vertical direction toward the nozzle face 200 of the recording head 14, so that the suction holder 61 is movable in the vertical direction while resisting the spring 62. A tube 63 is connected to each of the two suction ports 60A and 60B via the suction holder 61. A negative-pressure generating member, such as a suction pump, is connected to the tube 63.

FIG. 7B illustrates a state that the cleaning operation on the recording head 14 is performed by suction through application of a negative pressure to the suction ports 60A and 60B. The head holder 19 holds the recording head 14 by setting upper and lower positions of the recording head 14 in the vertical direction, in such a manner that the leading end of each of the suction ports 60A and 60B and the nozzle face 200 abut on each other. The wiper unit 46 is moved in the nozzle arranging direction while the negative-pressure generating member causes a negative pressure in the suction ports 60A and 60B. The ink and paper powder adhering to the nozzles can be thereby sucked and removed from the suction ports 60A and 60B. This operation is referred to as the cleaning operation. In the present exemplary embodiment, the wiper unit 46 of a suction wiper type is used. However, the present invention is not limited to this type. For example, a wiper for wiping the nozzle face 200 by using a wiper blade may be used.

Figure 8:
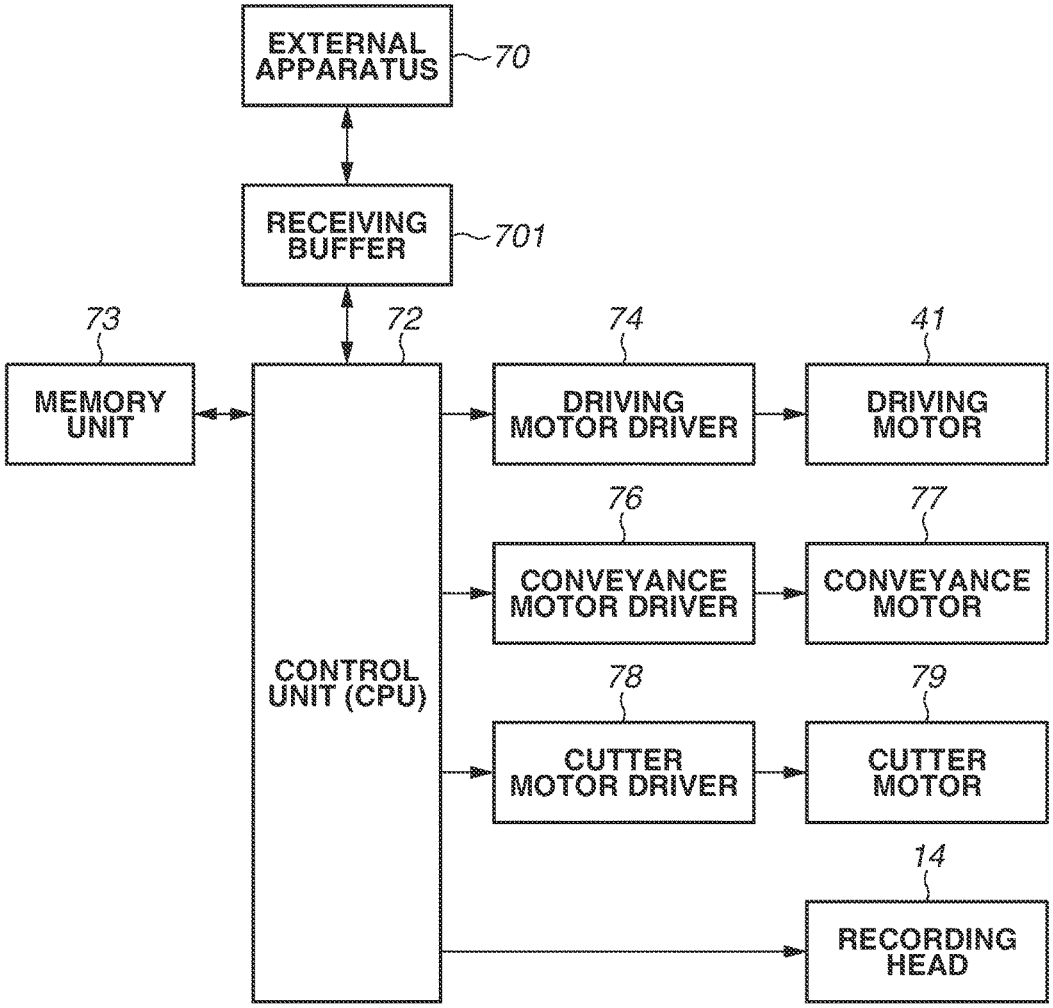
FIG. 8 is a block diagram illustrating a control system of the recording apparatus according to the first exemplary embodiment.

FIG. 8 is a block diagram illustrating a control system of the recording apparatus 100. Data of a character or an image to be recorded is input from the external apparatus 70 into a receiving buffer 701 of the recording apparatus 100. Further, data for checking whether data is correctly transferred and data for notifying an operation state of the recording apparatus 100 are output from the recording apparatus 100 to the external apparatus 70. The data in the receiving buffer 701 is transferred to a memory unit 73 and then temporarily stored into a RAM, under management of a control unit (CPU) 72. The CPU 72 controls each mechanism according to various programs stored in a read only memory (ROM) (not illustrated). The CPU 72 temporarily saves various data into a RAM (not illustrated), and executes processing.

A driving motor driver 74 drives the driving motor 41 for mechanism portions (mechanical portions) including the head holder 19, the cap 51, and the wiper unit 46, in response to a command from the CPU 72. A conveyance motor driver 76 controls a conveyance motor 77 for conveying the sheet 300, in response to a command from the CPU 72. A cutter motor driver 78 controls a cutter motor 79 for cutting the sheet 300, in response to a command from the CPU 72. The commands from the CPU 72 control driving of the recording head 14 to cause the recording head 14 to execute the recording operation and a preliminary ejecting operation.

Next, control of the cleaning operation of the recording head 14 in the present exemplary embodiment will be described with reference to FIGS. 9, 10, and 11A to 11D. A flowchart in each of FIGS. 9 and 10 will be described below with reference to a specific example illustrated in each of FIGS. 11A to 11D. Specifically, a case, as a first case, will be described. In the first case, after recording is performed on a 10-inch wide sheet 310, recording is performed on a 4-inch wide sheet 304*a* at a position illustrated in FIG. 11B. Subsequently, a case, as a second case, will be described while making a comparison with the first case. In the second case, after recording is performed on the 10-inch wide sheet 310, recording is performed on a 4-inch wide sheet 304*b* at a position illustrated in FIG. 11C.

Figure 9:
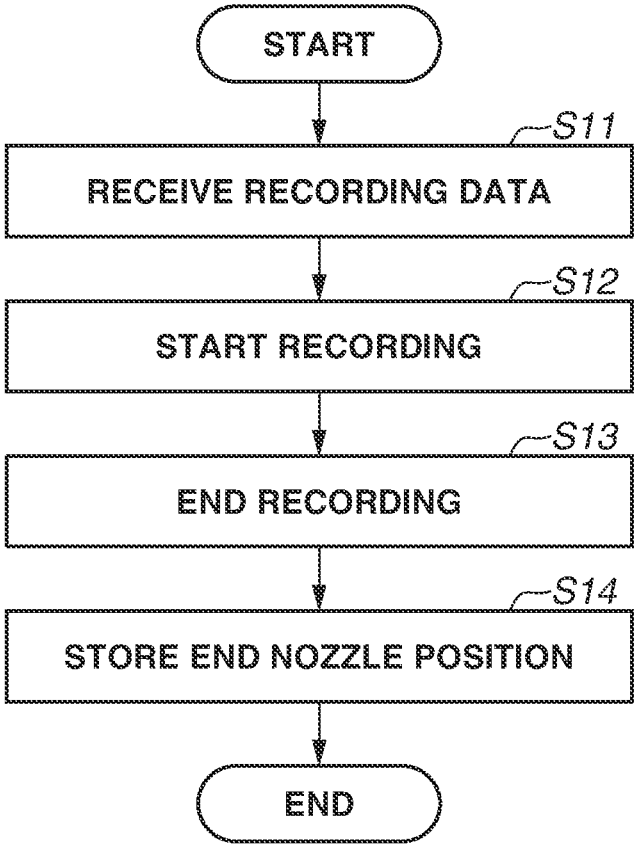
FIG. 9 is a flowchart illustrating control of a first recording operation according to the first exemplary embodiment.

FIG. 9 is a flowchart illustrating a control method of a first recording operation. First, in step S11, the recording apparatus 100 receives recording data, by receiving a recording-data recording instruction from the external apparatus 70.

In step S12, the CPU 72 starts the recording operation for the recording data received from the external apparatus 70. The recording head 14 in the present exemplary embodiment performs changing of the nozzle chips 220 to be used for the recording operation, based on the number of times the power is turned on, a predetermined time interval, or a dot count value, according to a recording data length in the nozzle arranging direction. This can prevent the nozzles from greatly varying in the cumulative number of ejections from the beginning of use. Further, even if the recording data length before the recording operation and the recording data length after the recording operation are identical, changing of the nozzle chips 220 to be used may be performed based on the above-described condition. In step S12, the CPU 72 thus determines the nozzle chips 220 to be used, based on the recording data received in step S11. The recording head 14 then moves in the nozzle arranging direction from the capping position to a recording position for performing recording on the sheet 310, and the conveyance unit 17 conveys the sheet 310 in the sheet conveyance direction. In step S12, the recording head 14 starts the recording operation for the sheet 310.

Upon completion of the recording operation, an inspection pattern and an image recorded on the sheet 310 are optically read. Subsequently, the sheet 310 after the recording is cut at a predetermined position, and then printing on the back surface and drying are performed. Pieces of the sheet 310 obtained thereby are then sequentially conveyed to the discharge tray 12 of the sorter unit 11. In step S13, the recording operation ends.

Figure 11A:
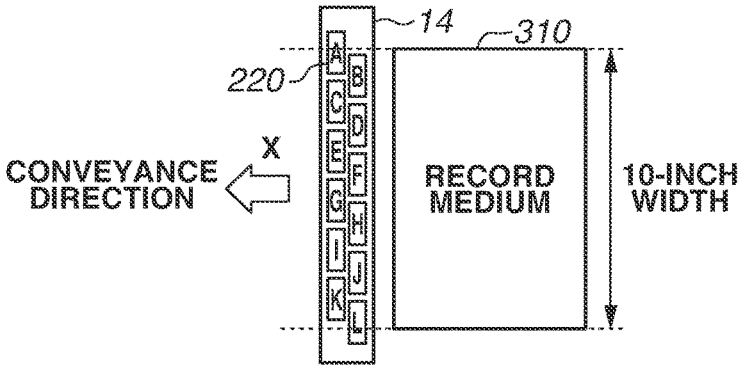
FIGS. 11A to 11D are diagrams each illustrating a specific example of a positional relationship between the recording head and a sheet.

Finally, in step S14, each end nozzle position (end passage position) in the recording head 14 where the respective ends, in the nozzle arranging direction, of the sheet 310 used in the current recording operation has passed is transferred to the memory unit 73 and temporarily stored into the RAM. In other words, information about a nozzle chip 220 of the recording head 14, which is a nozzle chip at a position opposite each of the ends, in the nozzle arranging direction, of the sheet 310 in the current recording operation is stored in the memory unit 73. Specifically, information about each of nozzle chips 220A and 220L passed by the respective ends of the sheet 310 in the nozzle arranging direction, among the nozzle chips 220 illustrated in FIG. 11A, is stored.

One reason for focusing on the ends of the sheet in the nozzle arranging direction is that paper powder is easily formed at the ends of the sheet. Formation of paper powder and adhesion of paper powder easily occur at the ends of the sheet, due to contact between the members of the units, such as the curl correction unit and the skew correction unit, and the ends of the sheet during the conveyance of the sheet. Therefore, the paper powder adhering to the sheet ends may scatter and then adhere to the nozzles of the recording head 14, when the sheet passes immediately below the recording head 14 during the recording operation and the rewinding operation described above. When the paper powder adheres to the nozzles, clogging may occur, which causes an ejection failure and leads to degradation in image quality. Since a large amount of paper powder may adhere to the nozzle chip 220 at the position opposite each of the ends of the sheet during the recording operation, the information about this nozzle chip 220 is stored. The paper powder may be formed not only during the conveyance of a roll-shaped continuous sheet, but also during the conveyance of cut sheets.

Figure 10:
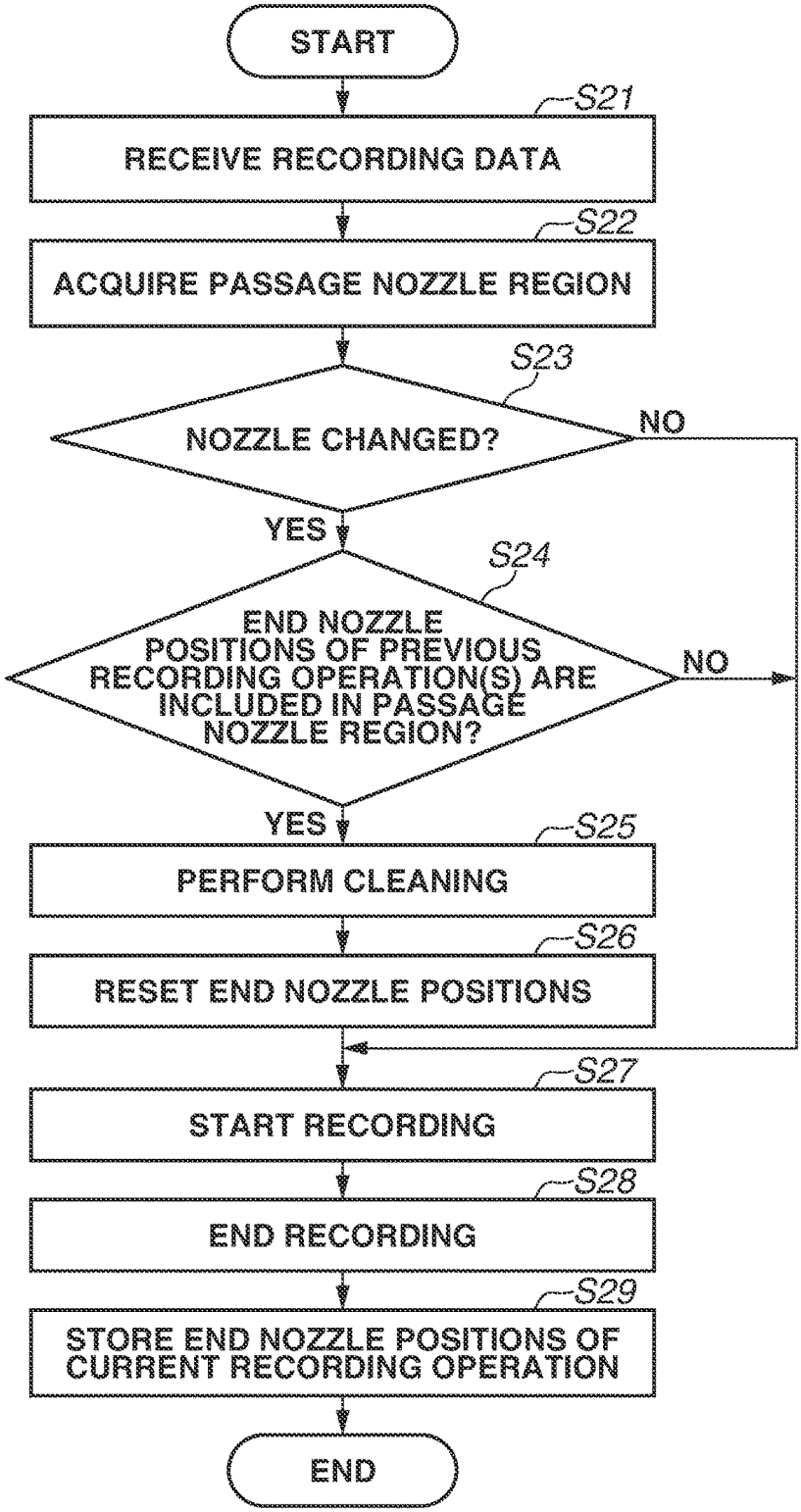
FIG. 10 is a flowchart illustrating control of a cleaning operation in association with a second recording operation according to the first exemplary embodiment.

Next, control of the cleaning operation in a second recording operation will be described with reference to the flowchart in FIG. 10. First, in step S21, the recording apparatus 100 receives recording data, by receiving a recording-data recording instruction from the external apparatus 70. In step S22, from the received recording data, the CPU 72 acquires information about the nozzle chips 220 of the recording head 14 (a passage nozzle region, or a passage region) each corresponding to a position where a sheet in the second recording operation is to pass. In other words, the CPU 72 acquires information about the nozzle chips 220 that may perform the recording operation for the sheet. In step S23, the CPU 72 determines whether the passage nozzle region in the first recording operation is changed to another passage nozzle region. The changing of the passage nozzle region in this process is synonymous with changing of a recording mode, and may be referred to below as a change operation.

In a case where the passage nozzle region (the recording mode) is not changed (NO in step S23), the processing proceeds to step S27. In step S27, the recording operation begins without execution of the cleaning operation, in response to a command from the CPU 72. Specifically, this corresponds to a case where the recording operation is performed using the nozzle chips 220A and 220L again, in the recording mode illustrated in FIG. 11A. In step S28, the recording ends. In step S29, the CPU 72 acquires the same end nozzle positions (the nozzle chips 220A and 220L) as those in the first recording, and stores the acquired end nozzle positions. One reason for not executing the cleaning operation when the recording mode remains unchanged is that the paper powder easily scatters toward the nozzles disposed on outer side in the nozzle arranging direction, among the nozzles disposed at the position opposite each of the ends of the sheet. Therefore, specifically, the paper powder may adhere to the nozzles disposed further outward in the nozzle arranging direction than the nozzles at the position opposite each of the ends of the sheet, among the nozzles provided in the nozzle chip 220A. This holds true for the nozzle chip 220L. However, if the recording mode in the second recording is the same as that in the first recording, the nozzles to which a large amount of paper powder is adhered are unlikely to be used. Therefore, it is not necessary to execute the cleaning operation.

Meanwhile, in a case where the passage nozzle region (the recording mode) is changed (YES in step S23), the processing proceeds to step S24. In step S24, the CPU 72 compares information about the passage nozzle region of the recording head 14, which indicates the region to be passed by the sheet in the second recording operation, with the end nozzle positions (a result) acquired in the first recording operation. In other words, in step S24, the CPU determines whether any of the end nozzle positions acquired in the first recording operation is included in the passage nozzle region in the second recording operation.

Figure 11B:
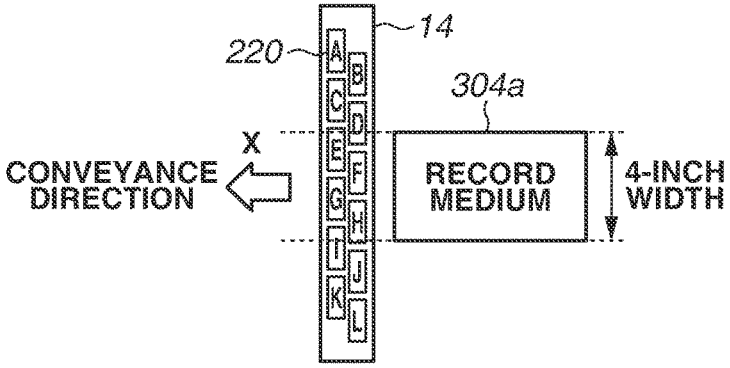

In a first case in which the recording is performed on the 4-inch wide sheet 304*a* at the position illustrated in FIG. 11B, the sheet 304*a* passes immediately below the six nozzle chips 220 in total, which are the nozzle chips 220D to 220I, in the second recording operation. Here, since the end nozzle positions acquired in the first recording are the nozzle chips 220A and 220L, these end nozzle positions are not included in the passage nozzle region (the nozzle chips 220D to 220I) to be passed by the sheet 304*a* in the second recording. The CPU 72 thus determines that any of the end nozzle positions is "not included" in the passage nozzle region (NO in step S24), and the processing proceeds to step S27. In step S27, the second recording operation starts without execution of the cleaning operation. In step S28, the second recording operation ends. In step S29, the CPU 72 stores the end nozzle positions (the nozzle chips 220D, 220E, 220H, and 220I) in the second recording operation, in addition to the end nozzle positions in the first recording operations (the nozzle chips 220A and 220L), and the processing ends. Accordingly, the six end nozzle positions of the nozzle chips 220A, 220D, 220E, 220H, 220I, and 220L are eventually stored into the memory unit 73.

Figure 11C:
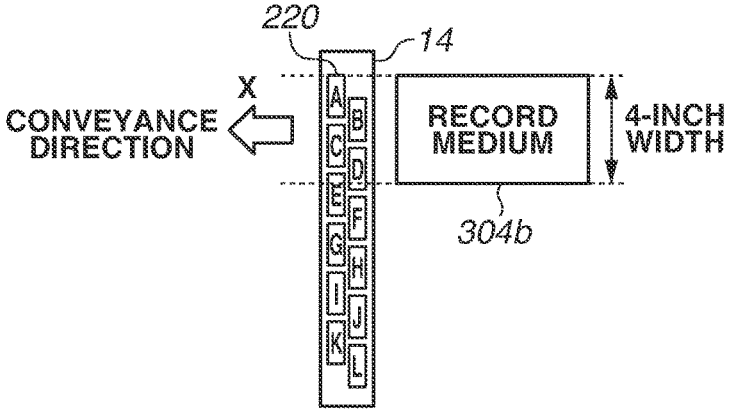

Meanwhile, in a second case in which the recording is performed on the 4-inch wide sheet 304*b* at the position illustrated in FIG. 11C, the sheet 304*b* passes immediately below the five nozzle chips 220 in total, which are the nozzle chips 220A to 220E, in the second recording operation. Here, since the end nozzle positions acquired in the first recording operation are the nozzle chips 220A and 220L, the nozzle chip 220A which is to be passed by the sheet in the second recording operation is included. The CPU 72 thus determines that any of the end nozzle positions is "included" in the passage nozzle region (YES in step S24), and the processing proceeds to step S25. In step S25, the cleaning operation is performed to remove paper powder by sucking the paper powder from each of the nozzles, using the wiper unit 46 as described above. After the cleaning operation, in step S26, the end nozzle positions acquired in the first recording operation are reset. In step S27, the second recording operation starts. In step S28, the second recording operation ends. In step S29, since the end nozzle positions in the first recording operations are reset in step S26, the CPU 72 acquires the end nozzle positions (the nozzle chips 220A, 220D, and 220E) in the second recording operation, and stores the acquired end nozzle positions, and the processing ends.

In this way, in the present exemplary embodiment, the CPU 72 determines whether to execute the cleaning operation, depending on whether the sheet in the second recording operation passes immediately below the nozzle chip 220 which has been opposite an end, in the nozzle arranging direction, of the sheet in the first recording operation. In other words, the cleaning operation is executed in a case where the sheet in the second recording operation passes immediately below the nozzle chip 220 which has been opposite an end, in the nozzle arranging direction, of the sheet in the first recording operation. Meanwhile, the cleaning operation is not executed when the sheet in the second recording operation does not pass immediately below the nozzle chip 220 which has been opposite an end, in the nozzle arranging direction, of the sheet in the first recording operation.

In the former case, paper powder generated from the end of the sheet may adhere to the nozzles (the nozzle chip) at the position opposite the end of the sheet during the first recording operation. However, even if an ejection failure occurs in these nozzles, the nozzles are not used in the second recording operation. It means that image quality of a printed product can be maintained in a good condition, even if the cleaning operation is not performed. In the former case, it is therefore not necessary to perform the cleaning operation before the second recording operation, and the second recording operation immediately starts.

In the latter case, the nozzle chip 220 which has been opposite an end of the sheet in the first recording operation is included in the passage nozzle region which is to be passed by the sheet in the second recording operation. It means that paper powder generated from the end of the sheet may adhere to the nozzles (the nozzle chip) at the position opposite the end of the sheet during the first recording operation, and an ejection failure may occur in these nozzles. Accordingly, the adhering paper powder is removed by executing the cleaning operation on the recording head 14 before the second recording operation, so that ejection failure and deterioration in image quality can be suppressed.

In this way, the cleaning operation can be executed at an appropriate timing, by controlling the cleaning operation by making a comparison between the end nozzle positions in the first recording operation and the passage nozzle region in the second recording operation. The consumption of the ink therefore can be reduced, in comparison with a case where the cleaning operation is performed every time the recording operation is performed. Moreover, since the operation to be performed before the recording operation can be omitted, the time from the receipt of the recording data to the completion of the recording can be reduced. In the present exemplary embodiment, the change operation is caused by changing the size of the sheet is described as an example, but the change operation is not limited to this example. The change operation may be caused by a movement of the recording head 14 in the nozzle arranging direction, even if the size of the sheet remains unchanged.

Figure 11D:
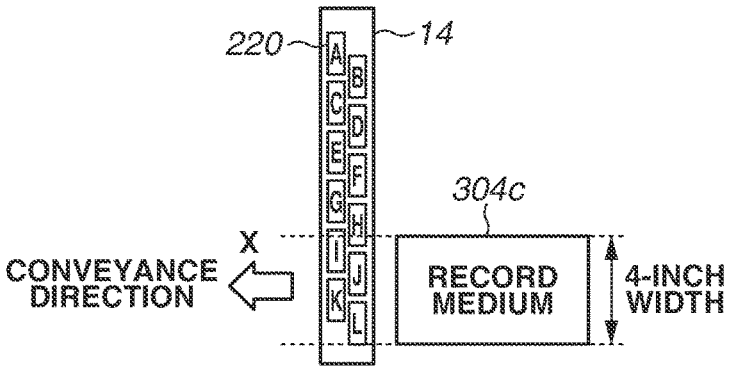

In the present exemplary embodiment, in a case where recording is performed on a 4-inch wide sheet 304*c* at a position illustrated in FIG. 11D in the first recording operation, the nozzle chips 220H, 220I, and 220L are stored as the end nozzle positions. In a case where recording is performed on the 4-inch wide sheet 304*a* at the position illustrated in FIG. 11B in the second recording operation, the nozzle chips 220D to 220I are set as the passage nozzle region in the second recording operation. In this case, since the nozzle chips 220H and 220I, which are the end nozzle positions, are included in the passage nozzle region in the second recording operation, the cleaning operation is executed before the second recording operation, unlike the specific example described above. However, in a case where recording is performed on the 4-inch wide sheet 304*b* at the position illustrated in FIG. 11C in the second recording operation, the nozzle chips (the nozzle chips 220H, 220I, and 220L) that are the end nozzle positions in the first recording operation are not included in the passage nozzle region (the nozzle chips 220A to 220E) in the second recording operation.

In the specific example described above, the first recording operation and the second recording operation are described. If the cleaning operation is not performed in the second recording operation, the end nozzle positions of the first recording operation and the second recording operation are compared with a passage nozzle region in third recording operation. In other words, the end nozzle positions are accumulated and stored until the cleaning operation is executed, and the end nozzle positions are reset when the cleaning operation is executed. The present invention is however not limited thereto. Control may be performed for making a comparison between only the end nozzle positions in the immediately preceding recording operation and the passage nozzle region in the current recording operation.

In the present exemplary embodiment, cleaning for the entire area of the recording head 14 is described as the cleaning operation. Alternatively, the cleaning operation may be selectively performed for the nozzle chips 220. In other words, if the sheet in the second recording operation passes immediately below the nozzles (the nozzle chip) at the positions opposite the ends of the sheet in the first recording operation, only these nozzles (the nozzle chip) may be cleaned. This makes it possible to suppress ejection failures, such as clogging of the nozzles due to the paper powder in the recording head 14, while further reducing the ink consumed by the cleaning operation. Alternatively, for portions near the nozzles (the nozzle chip) at the positions opposite the ends of the sheet in the first recording operation, the time for the cleaning operation may be longer than those for other nozzles. Specifically, for example, the moving speed of the wiper unit 46 in the nozzle arranging direction may be reduced in the cleaning for the portions near the nozzles to increase a suction period. Similarly, for the portions near the nozzles (the nozzle chip) at the positions opposite the ends of the sheet in the first recording operation, a suction strength may be set higher than those for other nozzles.

In the present exemplary embodiment, the recording head 14 of the line type in which the same nozzle chips 220 are arranged is used. Alternatively, a single nozzle chip may be disposed in the nozzle arranging direction. In that case, information about regions, in the single nozzle chip, at positions opposite the ends of the sheet in the first recording are compared with the passage nozzle region to be used in the second recording.

In the present exemplary embodiment, the wiping operation for removing the ink and the paper powder adhering to the nozzles is described as an example of the cleaning operation. Alternatively, similar control may be performed for an auxiliary ejection unit (not illustrated) for performing an auxiliary ejecting operation to remove the ink thickening in the nozzles. In other words, in a case where the sheet in the second recording operation passes immediately below the nozzles (the nozzle chip) at the positions opposite the ends of the sheet in the first recording operation, the auxiliary ejecting operation is performed by these nozzles or all the nozzles. Meanwhile, in a case where the sheet in the second recording operation does not pass immediately below the nozzles (the nozzle chip) at the positions opposite the ends of the sheet in the first recording operation, the recording operation starts without execution of the auxiliary ejecting operation. In addition, control similar to the control in the present exemplary embodiment may be performed for an operation related to recovery processing of the recording head 14.

Control for the cleaning operation of the recording head 14 according to a second exemplary embodiment will be described with reference to FIGS. 12 and 13. The basic configuration is similar to that in the first exemplary embodiment. In the present exemplary embodiment, the control for the cleaning operation is performed based on a conveyance amount of a roll-shaped continuous sheet. A flowchart in each of FIGS. 12 and 13 will be described with reference to the specific example illustrated in each of FIGS. 11A to 11D. Specifically, a description will be given for a case where after recording is performed on the 10-inch wide sheet 310 illustrated in FIG. 11A, recording is performed on the 4-inch wide sheet 304*b* at the position illustrated in FIG. 11C.

Figure 12:
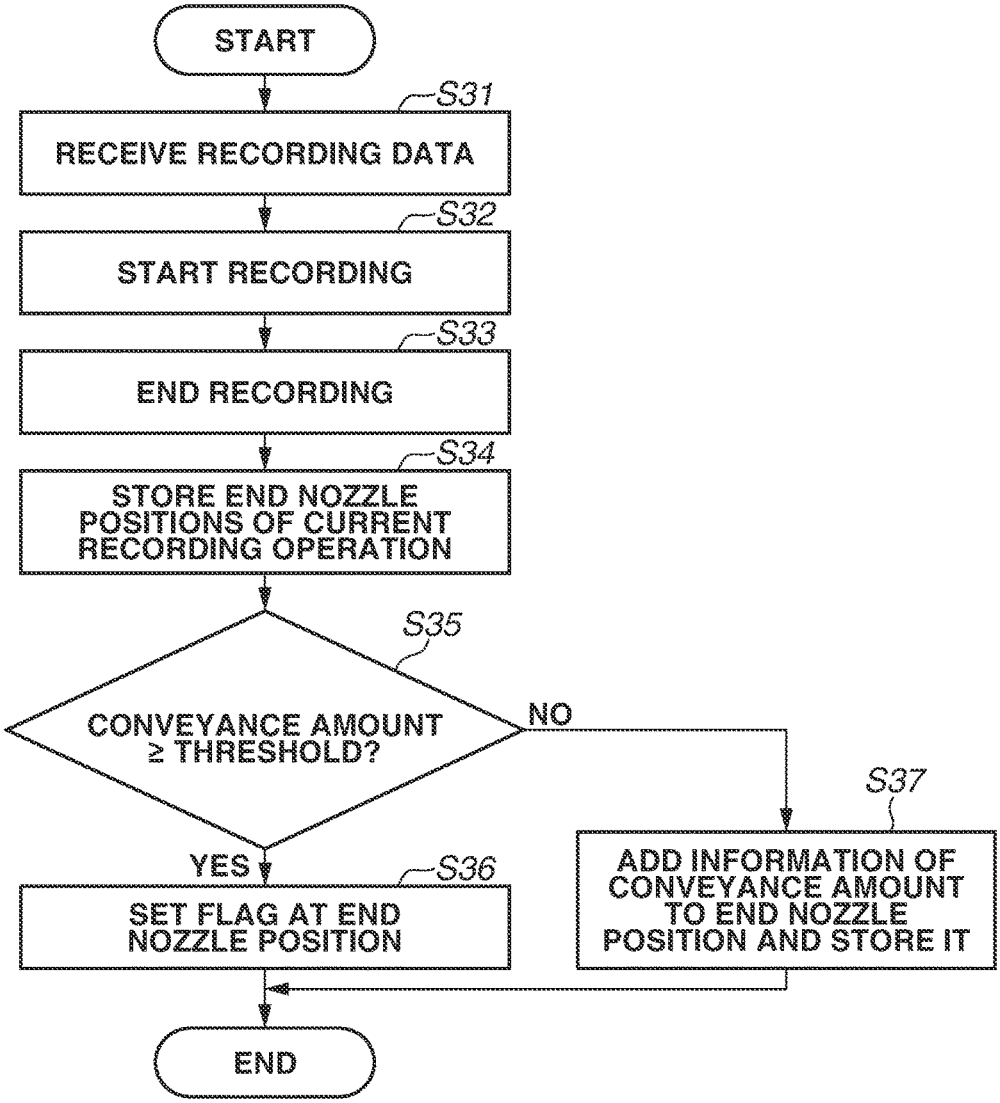
FIG. 12 is a flowchart illustrating control of a first recording operation according to a second exemplary embodiment.
Figure 13:
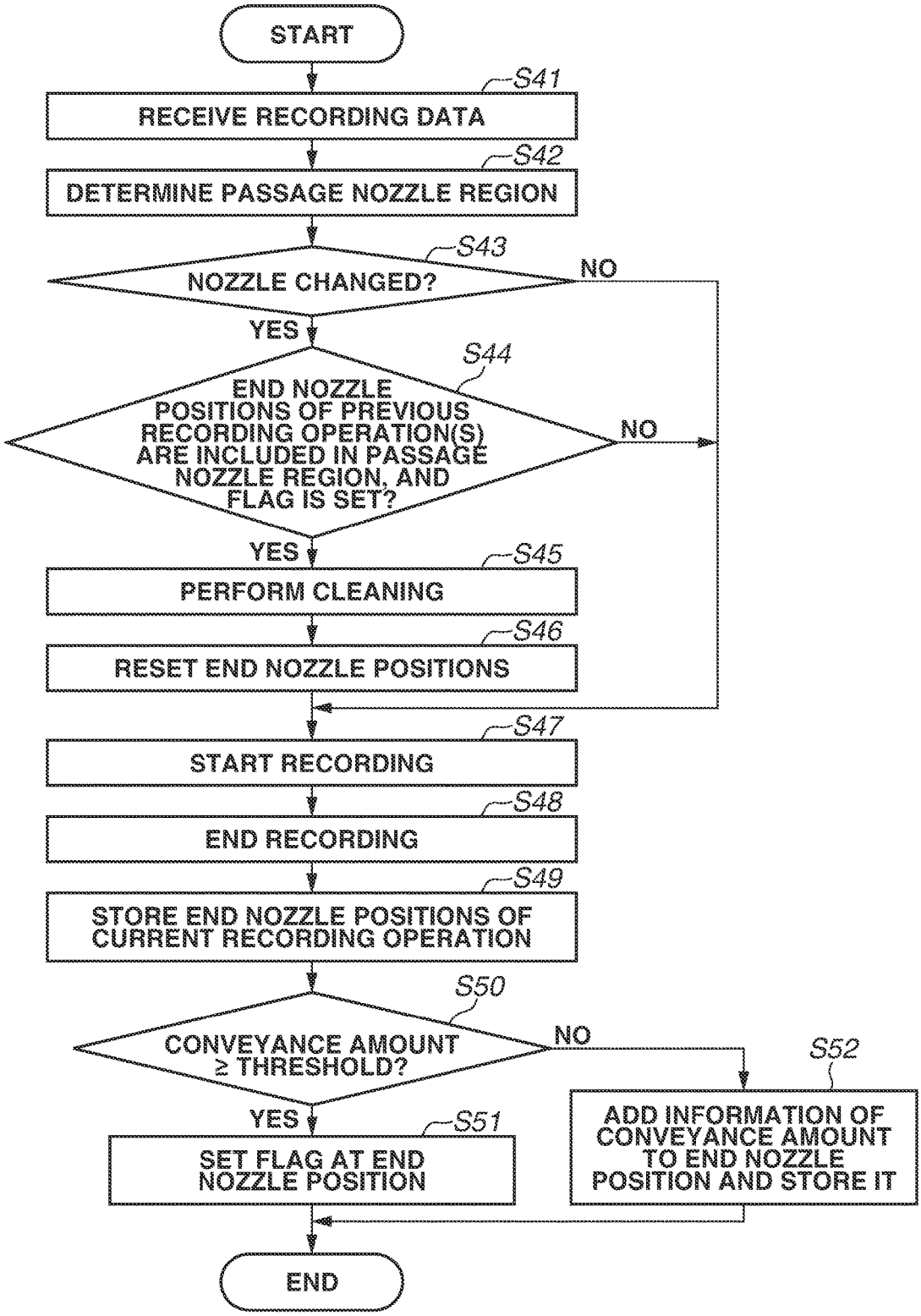
FIG. 13 is a flowchart illustrating control of a cleaning operation in association with a second recording operation according to the second exemplary embodiment.

FIG. 12 is a flowchart illustrating a control method for a recording operation according to the present exemplary embodiment. In step S31, the CPU 72 receives recording data from the external apparatus 70. In step S32, the CPU 72 starts the recording operation. In step S33, the recording operation ends. These step S31 to step S33 are similar to corresponding steps in the first exemplary embodiment. Next, in step S34, end nozzle positions of the recording head 14 are transferred to the memory unit 73 and temporarily stored into the RAM. The end nozzle positions are positions where the ends, in the nozzle arranging direction, of the sheet 310 in the current recording operation have passed. Specifically, information about the nozzle chips 220A and 220L passed by the respective ends of the sheet 310 in the nozzle arranging direction, among the nozzle chips 220 illustrated in FIG. 11A, is stored into the RAM.

In step S35, the CPU 72 determines whether a conveyance amount of the sheet is equal to or more than a given threshold at each of the end nozzle positions stored in step S34. In a case where the conveyance amount is equal to or more than the threshold (YES in step S35), the processing proceeds to step S36. In step S36, the CPU 72 sets a cleaning flag at the end nozzle position stored in step S34, and the first recording operation ends. For example, if the threshold is 500 m, and the acquired conveyance amount in the nozzle chip 220A is 700 m, the cleaning flag is set at the nozzle chip 220A. On the other hand, if the conveyance amount is below the threshold (NO in step S35), the operation proceeds to step 37. In step 37, the CPU 72 adds information about the conveyance amount to each piece of information of the end nozzle positions stored in step S34 and stores it into the memory unit 73. The CPU 72 then ends the first recording operation. Specifically, if the acquired conveyance amount at the nozzle chip 220L is 400 m, information indicating a conveyance amount of 400 m at the nozzle chip 220L is stored into the memory unit 73.

Next, a control method for the cleaning operation accompanying the second recording operation will be described with reference to the flowchart in FIG. 13. In step S41, the CPU 72 receives recording data from the external apparatus 70. In step S42, the CPU 72 acquires a passage nozzle region in the second recording operation. In a specific example of the present exemplary embodiment in which a recording operation is performed on the 4-inch wide sheet 304*b* as illustrated in FIG. 11C, the nozzle chips 220A to 220E are determined as the passage nozzle region. In step S43, the CPU 72 determines whether the passage nozzle region is changed. In a case where the passage nozzle region is not changed (NO in step S43), the operation proceeds to step S47, without execution of the cleaning operation. In step S47, the CPU 72 starts recording.

Meanwhile, as in the specific example in the present exemplary embodiment, in a case where the passage nozzle region is changed (YES in step S43), the processing proceeds to step S44. In step S44, the CPU 72 determines whether there is a nozzle chip 220 at which the cleaning flag is set by the first recording operation, in the passage nozzle region determined by the CPU 72 in step S43. If the conveyance amount after completion of the first recording is 400 m, no cleaning flag is set at the nozzle chips 220A and 220L. Therefore, the CPU 72 determines that there is no nozzle chip 220 at which the cleaning flag is set by the first recording operation, in the passage nozzle region determined by the CPU 72 (NO in step S44). The processing then proceeds to step S47, without execution of the cleaning operation. In step S47, the CPU 72 starts recording. In step S48, the recording ends. In step S49, the end nozzle positions (the nozzle chips 220D and 220E) in the second recording operation are stored together with the end nozzle positions (the nozzle chips 220A and 220L) in the first recording operation, in response to a command from the CPU 72. Accordingly, four end nozzle positions of the nozzle chips 220A, 220D, 220E, and 220L are eventually stored into the memory unit 73.

In step S50, the CPU 72 determines whether the conveyance amount of the sheet in each of the nozzle chips 220 included in the end nozzle positions is equal to or more than a threshold, for each of the nozzle chips 220. In a case where the conveyance amount of the sheet is equal to or more than the threshold (YES in step S50), the processing proceeds to step S51. In step S51, the CPU 72 sets the cleaning flag at the nozzle chip 220 in which the conveyance amount is equal to or more than the threshold. The CPU 72 then ends the second recording. In the specific example, if the conveyance amount is equal to or more than the threshold in all the four nozzle chips 220A, 220D, 220E, and 220L stored as the end nozzle positions, the CPU 72 sets the flag at each of these four nozzle chips 220. Meanwhile, in a case where the conveyance amount is less than the threshold (NO in step S50), the processing proceeds to step S52. In step S52, the CPU 72 adds information indicating the conveyance amount to each piece of information about the end nozzle positions stored in step S49 and stores it into the memory unit 73. The CPU 72 then ends the second recording. In the specific example, if the conveyance amount is less than the threshold in all the four nozzle chips 220A, 220D, 220E, and 220L, information indicating the conveyance amount is added to each of these nozzle chips and is stored.

Meanwhile, if the conveyance amount after completion of the first recording is 700 m, the flag is set at each of the nozzle chips 220A and 220L. Therefore, the CPU 72 determines that there is the nozzle chip 220 at which the cleaning flag is set by the first recording operation, in the passage nozzle region determined by the CPU 72 (YES in step S44). In other words, the nozzle chip 220A is included in the passage nozzle region in the second recording operation, and the cleaning flag is set at the nozzle chip 220A by the first recording. That is, there is a nozzle chip 220 meeting these two conditions. In such a case, in step S45, the cleaning operation is executed by a command from the CPU 72. In step S46, the CPU 72 resets the end nozzle positions and the cleaning flags in the first recording operation. Then, in step S47, the CPU 72 starts the recording operation. In step S48, the recording operation ends. In step S49, since the end nozzle positions in the first recording operation are reset in step S46, the CPU 72 stores the end nozzle positions (the nozzle chips 220A, 220D, and 220E) in the second recording operation into the memory unit 73. After that, in step S50, the CPU 72 determines whether the conveyance amount of the sheet is equal to or more than the threshold in each of the nozzle chips 220 included in the end nozzle positions. In a case where the conveyance amount of the sheet is equal to or more than the threshold (YES in step S50), the processing proceeds to step S51. In step S51, the CPU 72 sets the cleaning flag at the nozzle chip 220 for which the conveyance amount is equal to or more than the threshold. The CPU 72 then ends the second recording operation. Meanwhile, in a case where the conveyance amount is less than the threshold (NO in step S50), the processing proceeds to step S52. In step S52, the CPU 72 adds information indicating the conveyance amount to each piece of information of the end nozzle positions stored in step S49 and stores it into the memory unit 73. The CPU 72 ends the second recording operation.

In this way, in the present exemplary embodiment, whether to execute the cleaning operation is determined based on the conveyance amount of the sheet, in addition to the control in the first exemplary embodiment. More specifically, the cleaning operation is executed, when the conveyance amount is equal to or more than the threshold, and when a nozzle chip 220 which has been opposite an end of the sheet, in the nozzle arranging direction, in the first recording operation is to be used in the second recording operation. In other words, the cleaning operation is not executed when the conveyance amount is less than the threshold, even if a nozzle chip 220 which has been opposite an end of the sheet, in the nozzle arranging direction, in the first recording operation is to be used in the second recording operation.

In the above-described way, the cleaning operation can be executed at a more appropriate timing, by controlling the cleaning operation by providing more conditions as compared with the first exemplary embodiment. Therefore, the amount of the ink consumed by the cleaning operation can be further reduced.

Control for a cleaning operation of the recording head 14 according to a third exemplary embodiment will be described with reference to FIG. 14A. The basic configuration is similar to those in the first and second exemplary embodiments. In the present exemplary embodiment, the control for the cleaning operation is performed based on a conveyance amount and a conveyance speed of a roll-shaped continuous sheet.

FIG. 14A is a diagram illustrating a relationship between a conveyance speed of the continuous sheet and a factor for multiplying the conveyance amount. If a continuous sheet is conveyed as in the present exemplary embodiment, the higher the conveyance speed is, the more easily the paper powder is formed at the ends of the sheet. In other words, the conveyance speed and the amount of formed paper powder are proportional. Therefore, the factor for multiplying the conveyance amount according to the level of the conveyance speed is set, when the control is performed based on the conveyance amount of the second exemplary embodiment. In other words, the factor for multiplying the conveyance amount is small when the conveyance speed is low, whereas the factor for multiplying the conveyance amount is large when the conveyance speed is high. For example, when the conveyance speed is 1.0 inch/sec, the conveyance amount is multiplied by 0.6. When the conveyance speed is 5.0 inch/sec, the conveyance amount is multiplied by 1.4. Therefore, whether the conveyance amount is equal to or more than the threshold (each of step S35 and step S50) in the second exemplary embodiment can be determined based on the conveyance speed. The cleaning operation can be thus performed at a more appropriate timing. The amount of paper powder formed at the ends of the sheet varies depending on the type of the sheet. For this reason, the factor for multiplying the conveyance amount may be changed depending on the type of the sheet, as illustrated FIG. 14B.

According to exemplary embodiments of the present invention, the ink jet recording apparatus performs the cleaning operation at an appropriate timing, on the nozzles of the recording head which are located opposite the positions at which the ends of the record medium pass.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-129400, filed Jun. 29, 2016, which is hereby incorporated by reference herein in its entirety.

What is claimed is:

1. An ink jet recording apparatus comprising:

a conveyance unit configured to convey a record medium in a first direction;

a recording head having a nozzle arrangement region in which a plurality of nozzles for discharging ink is arranged in a second direction intersecting the first direction, the recording head being configured to perform a recording operation for recording on the record medium;

a cleaning unit configured to perform a cleaning operation on the recording head; and a control unit configured to control the cleaning operation performed by the cleaning unit, wherein a change operation changes relative position relation between a region where the record medium passes and the nozzle arrangement region, wherein the control unit acquires end passage positions and a passage region, the end passage positions being positions in the nozzle arrangement region facing to positions where two side edges of the record medium in the second direction pass in a first recording operation before the change operation is performed, and the passage region being a region in the nozzle arrangement region facing to a region where the record medium passes in a second recording operation after the change operation is performed, and wherein the control unit performs control for executing the cleaning operation in a case where the end passage position is included in the passage region, and control for not executing the cleaning operation in a case where the end passage position is not included in the passage region.

2. The ink jet recording apparatus according to claim 1, wherein information about the end passage position includes a position, of an end nozzle among the plurality of nozzles, where the end of the record medium in the first recording operation passes, and information about the passage region includes a passage nozzle region, in the plurality of nozzles, where the record medium in the second recording operation passes.

3. The ink jet recording apparatus according to claim 2, wherein, in a case where nozzles at the end nozzle position in the first recording operation are included in the passage nozzle region in the second recording operation, the cleaning operation is performed on the nozzles at the end nozzle position in a level stronger than a level of the cleaning operation for other nozzles in the plurality of nozzles.

4. The ink jet recording apparatus according to claim 2, wherein, in a case where nozzles at the end nozzle position in the first recording operation are included in the passage nozzle region in the second recording operation, the cleaning operation is performed only on the nozzles at the end nozzle position.

5. The ink jet recording apparatus according to claim 2, further comprising an acquiring unit configured to acquire a conveyance amount of the record medium conveyed immediately below the recording head, wherein, even in a case where nozzles at the end nozzle position in the first recording operation are included in the passage nozzle region in the second recording operation, the cleaning operation is not performed, in a case where the conveyance amount is less than a threshold in the nozzles at the end nozzle position.

6. The ink jet recording apparatus according to claim 2, wherein the cleaning unit includes a wiper unit, and the cleaning operation includes a wiping operation.

7. The ink jet recording apparatus according to claim 6, wherein the wiper unit has a suction unit, and sucks ink from the plurality of nozzles using the suction unit in the wiping operation.

8. The ink jet recording apparatus according to claim 7, wherein, in a case where nozzles at the end nozzle position in the first recording operation are included in the passage nozzle region in the second recording operation, the wiper unit performs the wiping operation on the nozzles at the end nozzle position longer than on other nozzles in the plurality of nozzles.

9. The ink jet recording apparatus according to claim 7, wherein, in a case where nozzles at the end nozzle position in the first recording operation is included in the passage nozzle region in the second recording operation, the wiper unit performs the wiping operation on the nozzles at the end nozzle position at a suction strength higher than on other nozzles in the plurality of nozzles.

10. The ink jet recording apparatus according to claim 2, wherein the nozzle arrangement region includes a plurality of nozzle chips, wherein the information about the end passage position is a nozzle chip including the end nozzle position, and the information about the passage region is a nozzle chip including the passage nozzle region.

11. A cleaning method for an ink jet recording apparatus, the ink jet recording apparatus including a conveyance unit configured to convey a record medium in a first direction, a recording head having a nozzle arrangement region in which a plurality of nozzles for discharging ink is arranged in a second direction intersecting the first direction, the recording head being configured to perform a recording operation for recording on the record medium, and a cleaning unit configured to perform a cleaning operation on the recording head, the cleaning method comprising:

performing a change operation for changing relative position relation between a region where the record medium passes and the nozzle arrangement region;

acquiring, as first acquiring, end passage positions in the nozzle arrangement region facing to positions where two ends of the record medium in the second direction pass, in a first recording operation before the change operation;

acquiring, as second acquiring, a passage region in the nozzle arrangement region facing to a region where the record medium passes, in a second recording operation after the change operation; and performing control for executing the cleaning operation in a case where the end passage position is included in the passage region, and control for not executing the cleaning operation in a case where the end passage position is not included in the passage region.

* * * * *